US012252860B2

(12) United States Patent
Grant

(10) Patent No.: US 12,252,860 B2
(45) Date of Patent: Mar. 18, 2025

(54) MODULAR ELONGATE MEMBER RETAINING WALL

(71) Applicant: Kenneth J. Grant, Lovell, WY (US)

(72) Inventor: Kenneth J. Grant, Lovell, WY (US)

( * ) Notice: Subject to any disclaimer, the term of this patent is extended or adjusted under 35 U.S.C. 154(b) by 177 days.

(21) Appl. No.: 18/187,589

(22) Filed: Mar. 21, 2023

(65) Prior Publication Data

US 2023/0295893 A1 Sep. 21, 2023

Related U.S. Application Data

(60) Provisional application No. 63/322,075, filed on Mar. 21, 2022.

(51) Int. Cl.

| | |
|---|---|
| ***E02D 29/02*** | (2006.01) |
| *A63B 5/11* | (2006.01) |
| *E04H 4/00* | (2006.01) |

(52) U.S. Cl.

CPC ..... *E02D 29/0266* (2013.01); *A63B 5/11* (2013.01); *E04H 4/00* (2013.01)

(58) Field of Classification Search

CPC .. E02D 29/02; E02D 29/0258; E02D 29/0266
USPC ..... 405/284, 285
See application file for complete search history.

(56) References Cited

U.S. PATENT DOCUMENTS

| | | | | |
|---|---|---|---|---|
| 1,578,861 | A * | 3/1926 | Squire | E02D 5/20 405/285 |
| 4,869,018 | A * | 9/1989 | Scales | A01G 27/02 47/33 |
| 5,168,678 | A * | 12/1992 | Scott, Jr. | A01G 9/02 47/33 |
| 5,806,249 | A * | 9/1998 | Helms | A01G 9/28 47/33 |
| 6,088,987 | A * | 7/2000 | Simmons | E04B 2/14 52/592.4 |
| 6,135,675 | A * | 10/2000 | Moreau | E02D 5/02 405/285 |
| 7,775,746 | B2 * | 8/2010 | Kim | E02D 5/08 405/231 |
| 9,974,240 | B1 * | 5/2018 | Brinner | A01G 9/28 |
| 11,959,274 | B2 * | 4/2024 | Bowers | B29B 17/04 |
| 2023/0160199 | A1 * | 5/2023 | Bowers | B29B 17/0026 52/300 |

FOREIGN PATENT DOCUMENTS

KR 20110034255 A * 4/2011

* cited by examiner

*Primary Examiner* — Frederick L Lagman
(74) *Attorney, Agent, or Firm* — Kunzler Bean & Adamson

(57) ABSTRACT

Embodiments of the present disclosure include a wall module. The wall module includes a panel that includes a first portion having an end and a second portion having a first end offset laterally from the end of the first portion in a first direction along a virtual plane. The wall module includes a plurality of pieces coupled to the first portion. Each piece of the plurality of pieces is configured to receive an end of an elongate member. The plurality of pieces include a first piece proximate to the end of the first portion of the panel. The first piece is configured to receive an end of a first elongate member. The wall modules includes a band coupled to the second portion in a position proximate to a second end of the second portion opposite to the first end of the second portion.

20 Claims, 15 Drawing Sheets

MODULAR ELONGATE MEMBER RETAINING WALL

CROSS-REFERENCES TO RELATED APPLICATIONS

This application claims the benefit of U.S. Provisional Patent Application No. 63/322,075 entitled "Universal Capstrip System for Retaining Walls" and filed on Mar. 21, 2022, for Kenneth J. Grant, which is incorporated herein by reference.

FIELD

This disclosure relates generally to retaining walls, fences, and debris barriers.

BACKGROUND

Certain play units, such as pools and trampolines, can be installed in-ground such that the play space is within an environment that may contain debris and from external objects, animals and people.

SUMMARY

Embodiments of the present disclosure include a wall module. The wall module includes a panel. The panel includes a first portion having an end and a second portion having a first end offset laterally from the end of the first portion in a first direction along a virtual plane. The wall module includes a plurality of pieces coupled to the first portion of the panel. Each piece of the plurality of pieces is configured to receive an end of an elongate member of a plurality of elongate members. The plurality of pieces include a first piece proximate to the end of the first portion of the panel. The first piece is configured to receive an end of a first elongate member of the plurality of elongate members. The wall modules includes a band coupled to the second portion in a position proximate to a second end of the second portion opposite to the first end of the second portion. The band is configured to receive a second elongate member of the plurality of elongate members. At least one of the plurality of elongate members extends in a second direction substantially perpendicular to the first direction. The band is offset from the first piece in the second direction.

Embodiments of the present disclosure include a modular retaining wall system. The modular retaining wall system includes a first plurality of wall modules. Each wall module of the plurality of wall modules includes a first wall module. The first wall module includes a first panel. The first panel includes a first portion having an end and a second portion having a first end offset laterally from the end of the first portion in a first direction along a virtual plane. The first wall module includes a plurality of pieces coupled to the first portion of the first panel, each piece of the plurality of pieces configured to receive an end of an elongate member of a plurality of elongate members. The plurality of pieces include at least one piece extending in a second direction substantially perpendicular to the first direction and a first piece proximate to the end of the first portion of the panel and configured to receive an end of a first elongate member of the plurality of elongate members. The first wall module includes a band coupled to the second portion, positioned proximate to a second end of the second portion opposite to the first end of the second portion, and configured to receive a second elongate member of the plurality of elongate members. The first plurality of wall modules includes a second wall module adjacent to the first wall module, the second wall module including a band configured to receive the first elongate member. The first plurality of wall modules includes a third wall module adjacent to the first wall module. The third wall module includes a piece configured to receive and cover a first end of the second additional elongate member. The system includes a second plurality of wall modules. Each wall module of the second plurality of wall modules includes a panel and a second number of pieces, each piece of the second number of pieces coupled to the panel and configured to receive a second end of an elongate member of the number of elongate members. The second end is an end opposite to the first end.

Embodiments of the present disclosure include a method of building a retention wall. The method includes shaping a panel such that the panel includes a first portion having an end and a second portion having a first end offset laterally from the end of the first portion in a first direction along a virtual plane. The method includes coupling a plurality of pieces to the first portion of the panel, each piece of the plurality of pieces configured to receive an end of an elongate member of a plurality of elongate members. The plurality of pieces include a first piece proximate to the end of the first portion of the panel and configured to receive an end of a first elongate member of the plurality of elongate members. The method includes coupling a band to the first panel in a position proximate to a second end of the second portion opposite to the first end of the second portion. The band is configured to receive a second elongate member of the plurality of elongate members. The band is offset from the first piece in the second direction. At least one of the plurality of elongate members extends in a second direction substantially perpendicular to the first direction.

The subject matter of the present application has been developed in response to the present state of the art, and in particular, in response to the shortcomings of a retention wall or fence system for various shapes and sizes, particularly with in ground trampolines, that have not yet been fully solved by currently available techniques. Accordingly, the subject matter of the present application has been developed to provide a simple retention wall system for rectangular, square, round [and virtually any shape] in ground trampolines of any size that overcome at least some of the above-discussed shortcomings of prior art techniques. The model may also be used along any substance that needs a retention wall system.

The described features, structures, advantages, and/or characteristics of the subject matter of the present disclosure may be combined in any suitable manner in one or more examples and/or implementations. In the following description, numerous specific details are provided to impart a thorough understanding of examples of the subject matter of the present disclosure. One skilled in the relevant art will recognize that the subject matter of the present disclosure may be practiced without one or more of the specific features, details, components, materials, and/or methods of a particular example or implementation. In other instances, additional features and advantages may be recognized in certain examples and/or implementations that may not be present in all examples or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the subject matter may be more readily understood, a more particular description of the subject matter briefly described above will be rendered by reference to specific examples that are illustrated in the appended drawings. Understanding that these drawings, which are not necessarily drawn to scale, depict only certain examples of the subject matter and are not therefore to be considered to be limiting of its scope, the subject matter will be described and explained with additional specificity and detail through the use of the drawings, in which.

DETAILED DESCRIPTION

Figure 1A:
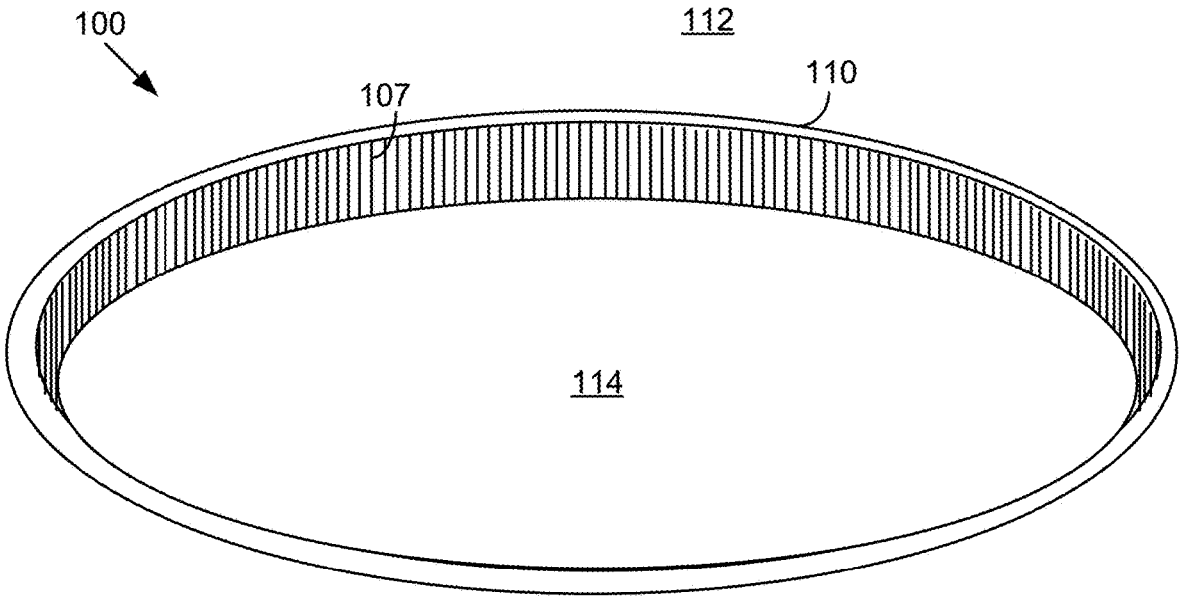
FIG. 1A illustrates a landscape perspective view of the system according to one or more examples of the present disclosure.

Reference throughout this specification to "one example," "an example," or similar language means that a particular feature, structure, or characteristic described in connection with the example is included in at least one example of the present disclosure. Appearances of the phrases "in one example," "in an example," and similar language throughout this specification may, but do not necessarily, all refer to the same example. Similarly, the use of the term "implementation" means an implementation having a particular feature, structure, or characteristic described in connection with one or more examples of the present disclosure, however, absent an express correlation to indicate otherwise, an implementation may be associated with one or more examples.

Embodiments of the present disclosure include a wall module. The wall module includes a panel. The panel includes a first portion having an end and a second portion having a first end offset laterally from the end of the first portion in a first direction along a virtual plane. The wall module includes a plurality of pieces coupled to the first portion of the panel. Each piece of the plurality of pieces is configured to receive an end of an elongate member of a plurality of elongate members. The plurality of pieces include a first piece proximate to the end of the first portion of the panel. The first piece is configured to receive an end of a first elongate member of the plurality of elongate members. The wall modules includes a band coupled to the second portion in a position proximate to a second end of the second portion opposite to the first end of the second portion. The band is configured to receive a second elongate member of the plurality of elongate members. At least one of the plurality of elongate members extends in a second direction substantially perpendicular to the first direction. The band is offset from the first piece in the second direction.

In some embodiments, each of the plurality of pieces includes a receiving receptacle. The wall module further includes a curved portion connected to at least one piece of the plurality of pieces. The curved portion is configured to guide the end of the elongate member into the receiving receptacle.

In some embodiments, each of the plurality of elongate members are substantially cylindrical in shape. Each of the plurality elongate members extends a length at least equal to the depth of a hole in the ground. In some embodiments, the panel is made of a flexible material.

In some embodiments, the plurality of pieces includes a number of pieces disposed between the first piece and the band in the first direction. In some embodiments, the panel includes a number of flanges. Each of the number of pieces is coupled to a first flange of the number of flanges extending outward from the piece in a first direction, wherein the first flange is connected to a second flange of the number of flanges extending outward from an adjacent piece of the number of pieces.

In some embodiments, each of the plurality of pieces includes a removable cap configured to cover the end of the elongate member. The removable cap includes a telescoping top.

In some embodiments, the first piece includes a channel configured to allow the first elongate member to pass through the first piece. The wall module includes a cap. The cap includes a first portion configured to fit within the first elongate member at a first end of the first elongate member and a second portion coupled to the first portion. The second portion has a width greater than a width of the first piece.

Embodiments of the present disclosure include a modular retaining wall system. The modular retaining wall system includes a first plurality of wall modules. The plurality of wall modules includes a first wall module. The first wall module includes a first panel. The first panel includes a first portion having an end and a second portion having a first end offset laterally from the end of the first portion in a first direction along a virtual plane. The first wall module includes a plurality of pieces coupled to the first portion of the first panel, each piece of the plurality of pieces configured to receive an end of an elongate member of a plurality of elongate members. The plurality of pieces include at least one piece extending in a second direction substantially perpendicular to the first direction and a first piece proximate to the end of the first portion of the panel and configured to receive an end of a first elongate member of the plurality of elongate members.

The first wall module includes a band coupled to the second portion, positioned proximate to a second end of the second portion opposite to the first end of the second portion, and configured to receive a second elongate member of the plurality of elongate members. The first plurality of wall modules includes a second wall module adjacent to the first wall module, the second wall module including a band configured to receive the first elongate member. The first plurality of wall modules includes a third wall module adjacent to the first wall module. The third wall module includes a piece configured to receive and cover a first end of the second additional elongate member. The system includes a second plurality of wall modules. Each wall module of the second plurality of wall modules includes a panel and a second number of pieces, each piece of the second number of pieces coupled to the panel and configured to receive a second end of an elongate member of the number of elongate members. The second end is an end opposite to the first end.

In some embodiments, each of the first plurality of wall modules and the second plurality of wall modules are configured to be connected through the number of elongate members to form an enclosure. The enclosure is substantially circular in shape. In some embodiments, a distance between each of the first plurality of wall modules and the second plurality of wall modules is substantially uniform throughout the enclosure.

In some embodiments, at least one of the wall modules of the first plurality of wall modules and/or the second plurality of wall modules is configured to be connected to at least one of an in-ground pool or a frame of an in-ground trampoline.

In some embodiments, the system includes a material not permeable to earth disposed on at least one side of the first plurality of wall modules. In some embodiments, the system includes a number of pivot members, each pivot member of the number of pivot member being rotatable about an axis substantially perpendicular to the first direction and to the second direction and connecting at least one of (i) a first wall module of the first plurality of wall modules to a second wall module of the first plurality of wall modules and/or (ii) a first wall module of the second plurality of wall modules to a second wall modules of the second plurality of wall modules.

In some embodiments, the first plurality of wall modules are configured such that the panel of each wall module contacts a panel of the first adjacent wall module and the second adjacent wall module such that each panel of the first plurality of wall modules forms a substantially continuous surface.

Embodiments of the present disclosure include a method of building a retention wall. The method includes shaping a panel such that the panel includes a first portion having an end and a second portion having a first end offset laterally from the end of the first portion in a first direction along a virtual plane. The method includes coupling a plurality of pieces to the first portion of the panel, each piece of the plurality of pieces configured to receive an end of an elongate member of a plurality of elongate members. The plurality of pieces include a first piece proximate to the end of the first portion of the panel and configured to receive an end of a first elongate member of the plurality of elongate members. The method includes coupling a band to the first panel in a position proximate to a second end of the second portion opposite to the first end of the second portion. The band is configured to receive a second elongate member of the plurality of elongate members. The band is offset from the first piece in the second direction. At least one of the plurality of elongate members extends in a second direction substantially perpendicular to the first direction.

Figure 1B:
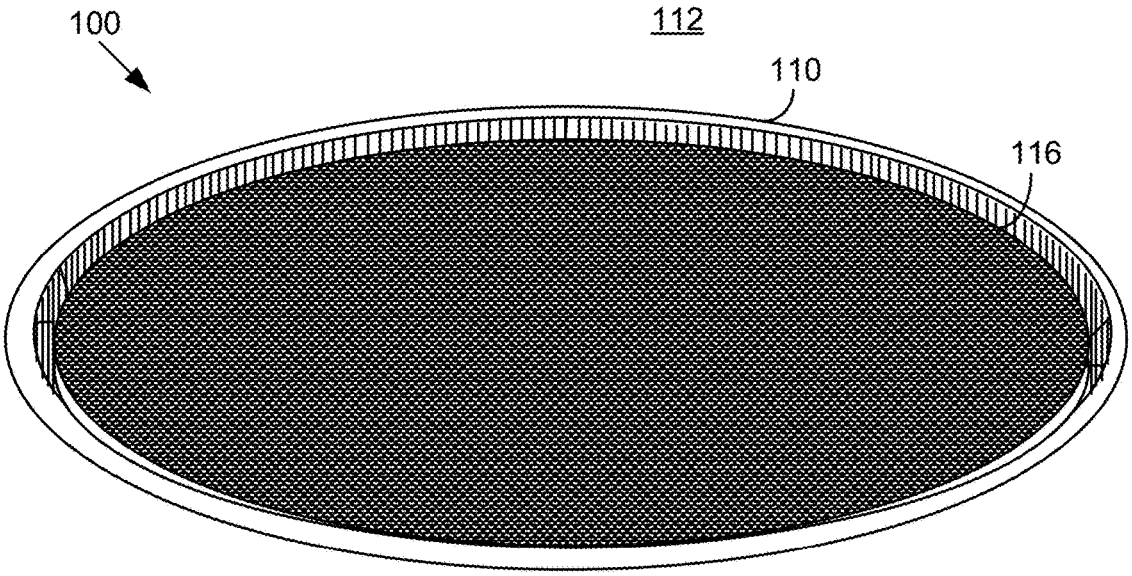
FIG. 1B illustrates a landscape perspective view of a system with a trampoline according to one or more examples of the present disclosure.
Figure 1C:
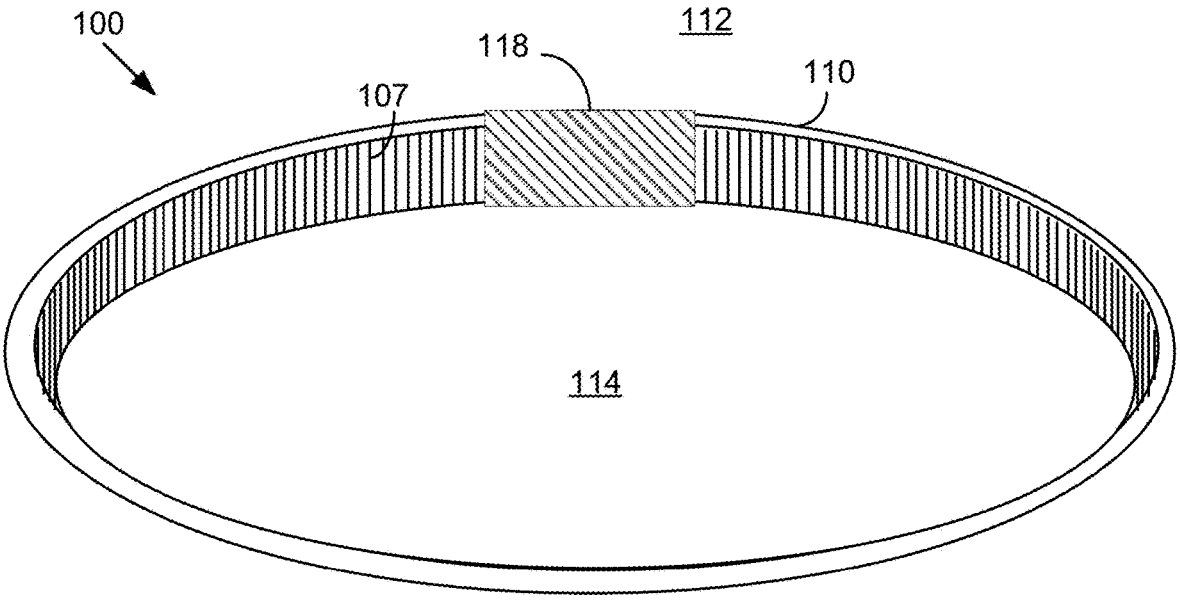
FIG. 1C illustrates a landscape perspective view of another embodiment of a system according to one or more examples of the present disclosure.
Figure 2:
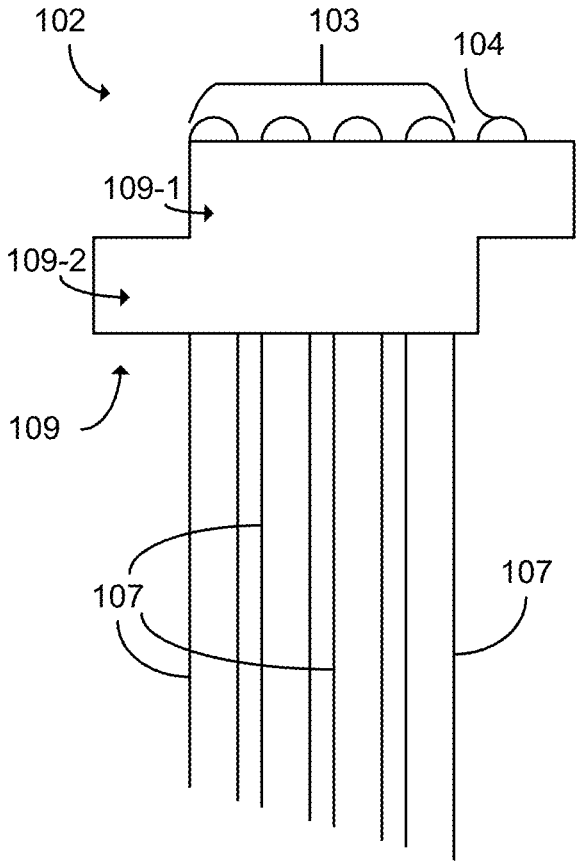
FIG. 2 illustrates a rear view of the system according to one or more examples of the present disclosure.
Figure 3:
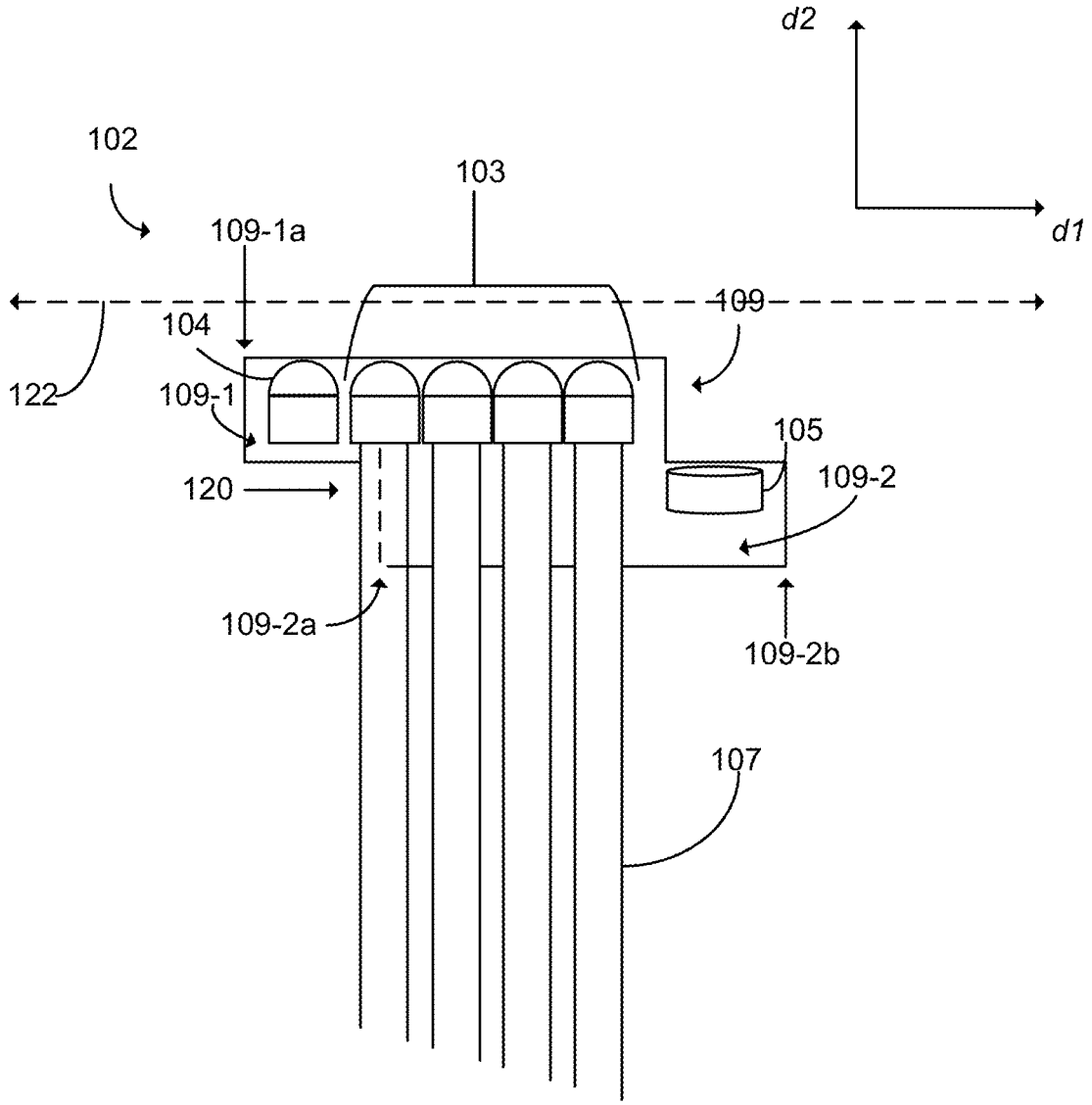
FIG. 3 illustrates a front view of the system according to one or more examples of the present disclosure.

Referring to FIGS. 1A-1C, a system 100 for building a wall is shown. In certain embodiments, the system 100 forms a wall that stands above ground and is comprised of a plurality of sections. In other embodiments, the system 100 forms a wall that is interconnected, such that the wall is placed in a pit or hole in the ground (e.g., an excavated hole for a trampoline) and encloses an area within the ground to retain soil and other debris and prevent it from collapsing or moving into the hole. In the illustrated example of FIGS. 1A-1C, the system 100 includes a framework 102. For example, the system 100 includes a framework 102, as illustrated in FIGS. 2-3. As used herein, the terms "framework" and "wall module" may be used interchangeably.

The framework 102 can be made of polyethylene or another appropriate flexible material, which may enable the framework 102 to be flexible and durable. The flexibility of the framework 102 allows it to form to various shapes. For example, the framework can form circles, squares, triangles, and/or the like. FIG. 1A illustrates the framework 102 formed in a circular shape within a hole in the ground. As shown in FIG. 1B, in one embodiment, at least one of an in-ground pool or an in-ground trampoline 116 may be attached to one of the frameworks 102.

As shown in FIG. 2, the framework 102 includes a plurality of components, portions, parts, pieces, and/or the like such as retaining end pieces 103, which are configured to receive a plurality of elongate members 107. In some embodiments, the elongate members 107 have a substantially cylindrical shape. For example, the elongate members 107 may be pipes or tubes such as Polyvinyl Chloride ("PVC") pipes, that have a substantially rigid form. In some embodiments, each of the elongate members 107 has a length that is substantially equal to a depth of a hole in the ground 112, where the system 101 is placed within the hole 110 such that the system 101 retains earthen materials, dirt, and/or debris from an enclosed area 114.

As shown in FIG. 3, in certain embodiments, the framework 102 includes an end cap 104 and a band 105. The end cap 104 is at one end of the framework 102. The band 105 is at an end of the framework 102 opposite the end cap 104 in a first direction d1. Retaining end pieces 103 are disposed between the end cap 104 and the band 105. The band 105 is, for example, collar-shaped. The band 105 includes an opening, aperture, and/or channel through which to receive an elongate member, such as elongate members 107.

As shown in FIG. 3, the framework 102 includes a panel 109. The panel 109 includes a first portion 109-1 having an end 109-1*a* and a second portion 109-2 having a first end 109-2*a*. The first end 109-2*a* is offset laterally from the end 109-1*a* of the first portion 109-1 in a first direction d1 parallel to a virtual plane 122. The plurality of pieces 103 are coupled to the first portion 109-1. In some embodiments, the panel 109 is made of a flexibly rigid material such as rubber, plastic, or the like.

Figure 9:
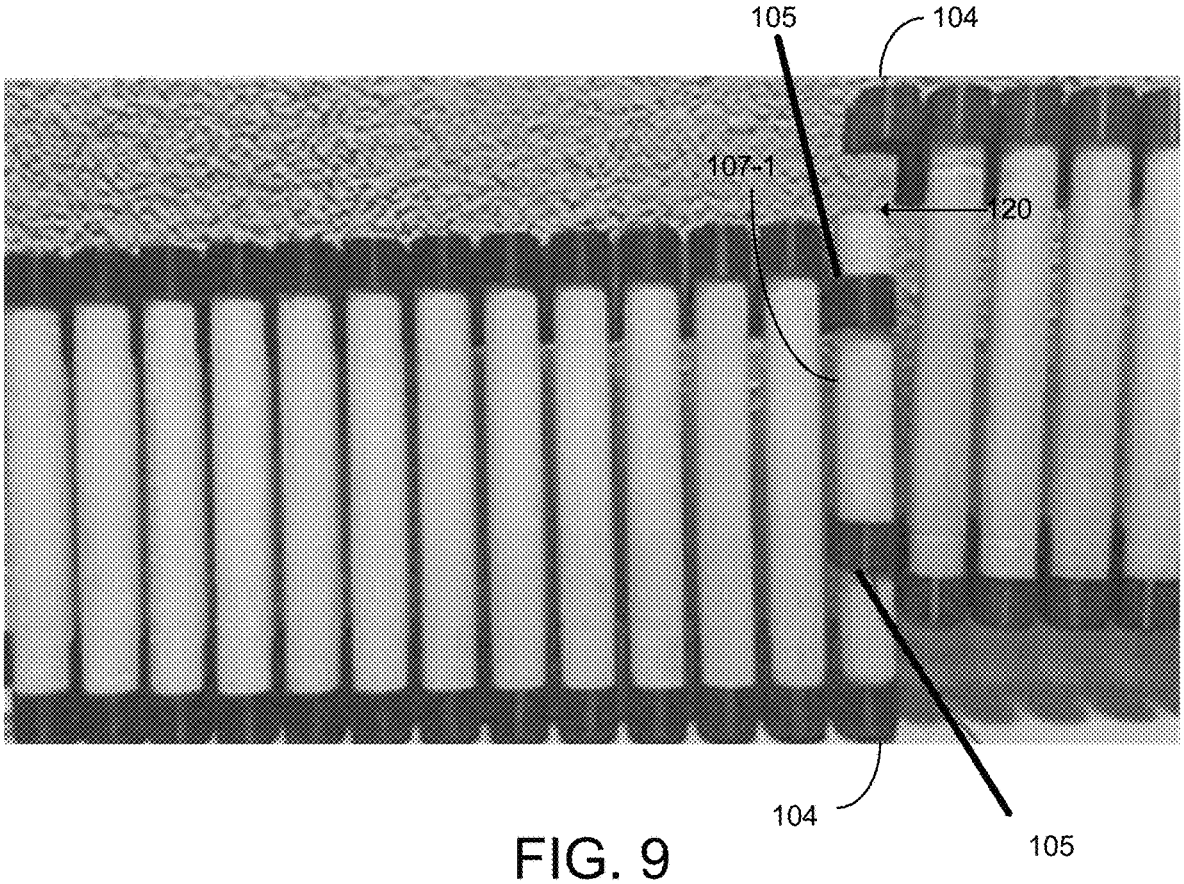
FIG. 9 illustrates a perspective view of an embodiment of assembling the system according to one or more examples of the present disclosure.

In one embodiment, each piece of the plurality of pieces 103 is configured to receive an end 120 of an elongate member 107 of a plurality of elongate members. The end cap 104, which may also be considered a "piece" of the framework 102, is positioned proximate to the end 109-1*a* of the first portion 109-1 As shown in FIG. 9, the end cap 104 is configured to receive an end 120 of a first elongate member 107-1.

The band 105, in one embodiment, is coupled to the second portion 109-2 of the panel 109. The band 105, in one embodiment, is proximate to a second end 109-2*b* of the second portion 109-2. The second end 109-2*b*, in certain embodiments, is opposite to the first end 109-2*a* of the second portion 109-2. The band 105, in one embodiment, is configured to receive a second elongate member 107-2, as shown in FIG. 9. The band 105, in some embodiments, is offset laterally from the end cap 104. In some embodiments, at least one of the plurality of elongate members 107 extends in a second direction d2 that is substantially perpendicular to the first direction d1. The band 105 may be offset from the end cap 104 in the second direction d2 as well as the first direction d1.

Figure 4:
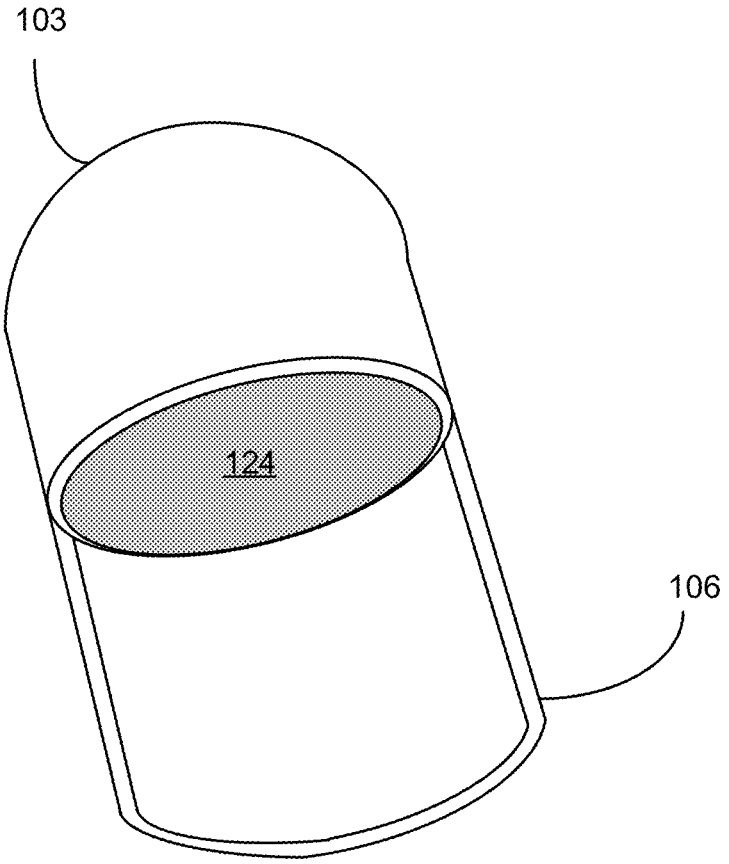
FIG. 4 illustrates one embodiment of a component of the system, according to one or more examples of the present disclosure.
Figure 5:
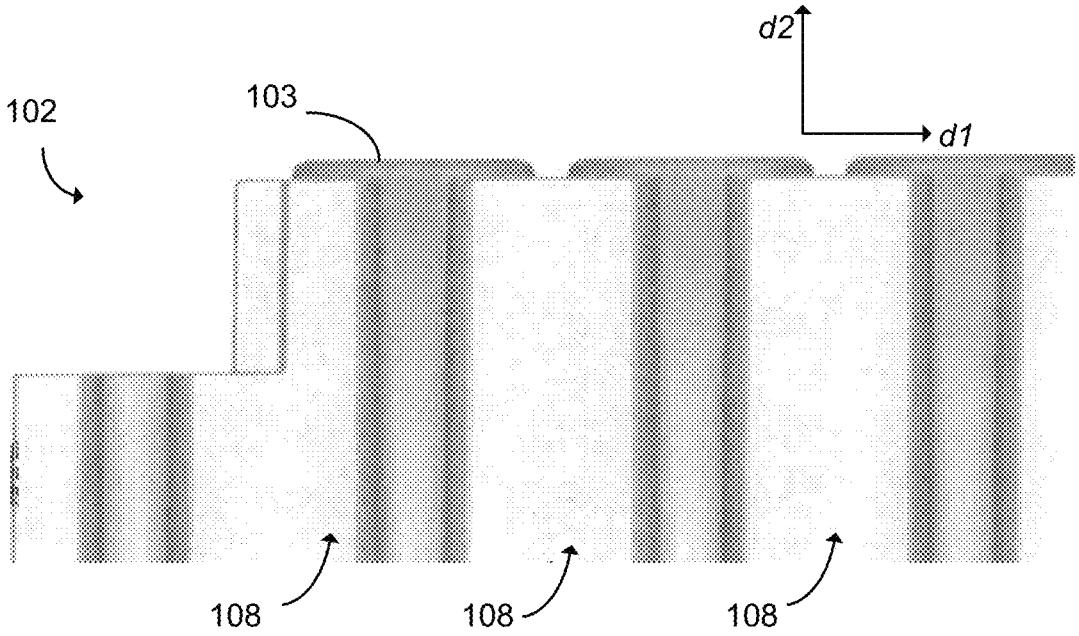
FIG. 5 illustrates another embodiment of a component of the system, according to one or more examples of the present disclosure.
Figure 6:
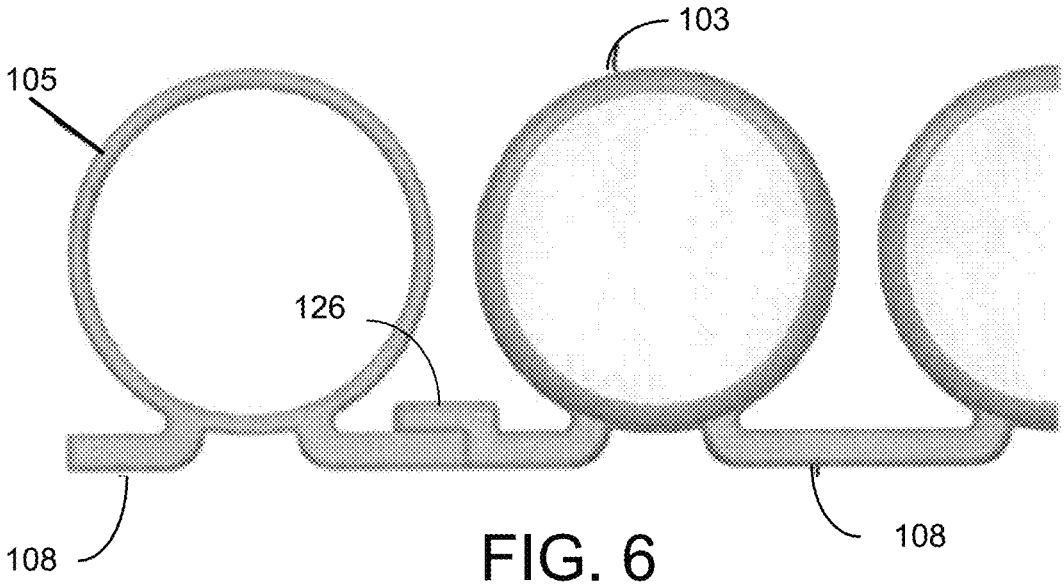
FIG. 6 illustrates a top view of an embodiment of the system according to one or more examples of the present disclosure.
Figure 7:
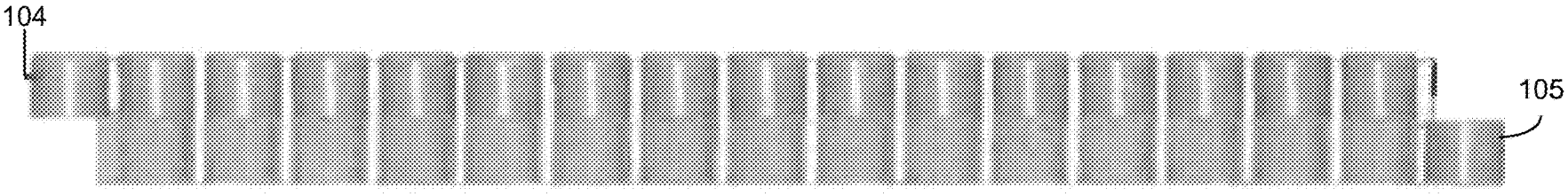
FIG. 7 illustrates a front view of an embodiment of the system according to one or more examples of the present disclosure.
Figure 8:
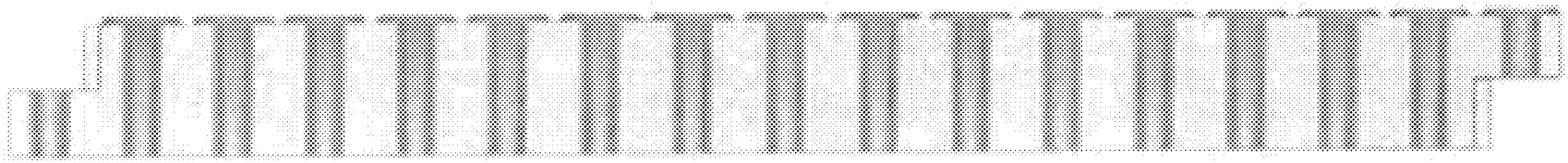
FIG. 8 illustrates a front view of another embodiment of the system according to one or more examples of the present disclosure.

Referring to FIGS. 2-4, another embodiment of the framework 102 of the system 100 is shown. In this embodiment, the framework 102 is made of individual pieces. The framework 102 includes a plurality of retaining end pieces 103, an end cap 104, a band 105, a panel 109, and a plurality of saddles 106. The framework 102 is configured to receive a number of elongate members 107.

FIG. 2 illustrates a back view of the framework 102. The plurality of retaining end pieces 103, the end cap 104, and the band 105 are removably connected to the back panel 109. FIG. 3 illustrates a front view of the framework 102. As depicted in FIG. 3, the panel 109 has an offset shape.

In one embodiment, the end cap 104 is attached the panel 109. Although not illustrated, in some embodiments, the first portion 109-1 of the panel 109 extends from a first end of the end cap 104 in a vertical direction (e.g., opposite to d2) and terminates at a point between the top and the bottom of the end cap 104 (in some embodiments, the back panel extends and terminates at the bottom of the saddle 106).

At a second end 109-2*b* of the back panel 109 opposite the end cap 104, in one embodiment, the back panel 109 extends from above the band 105 to a point below the band 105 in a second direction (e.g., opposite to d2).

Figure 11:
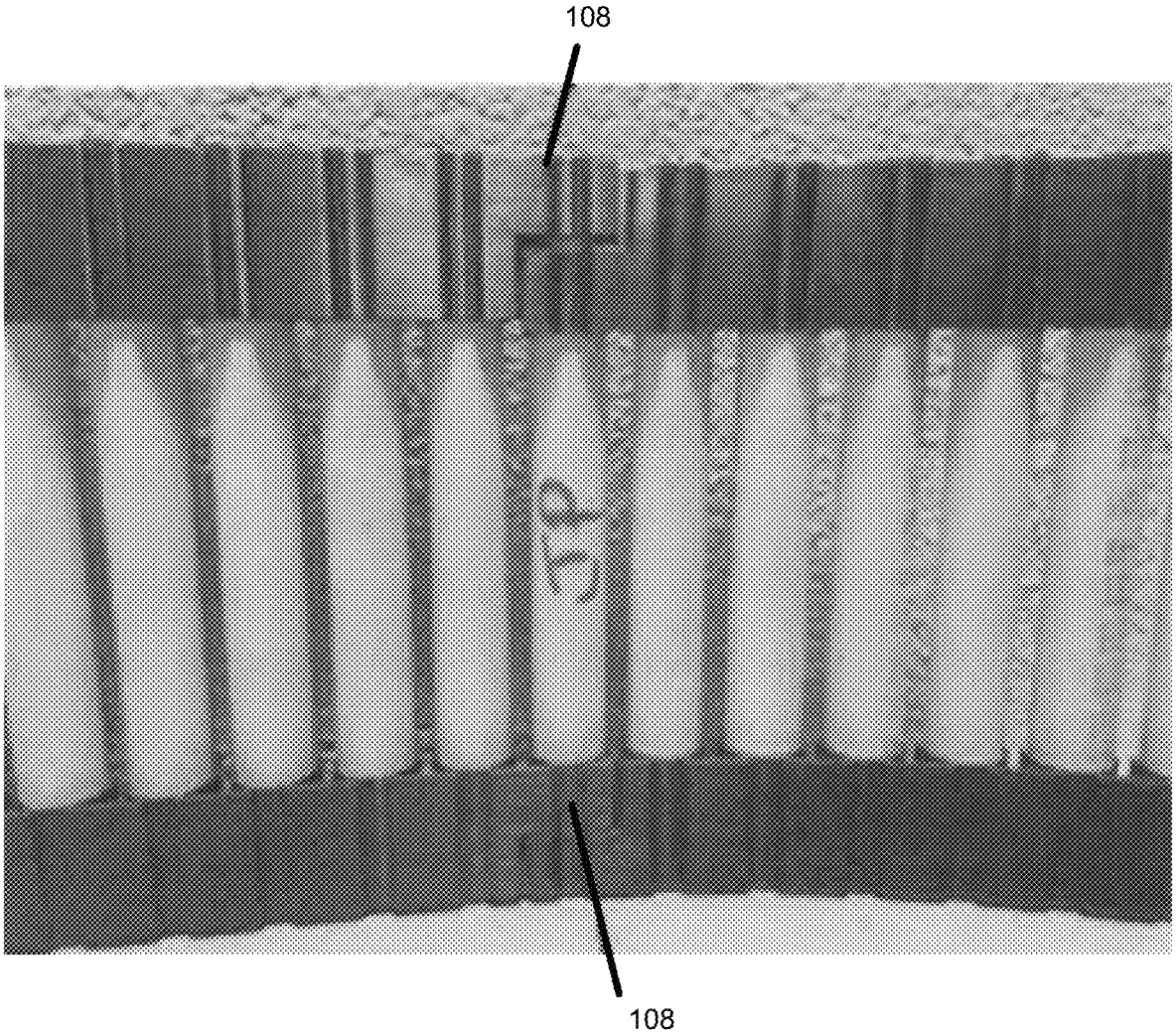
FIG. 11 illustrates a perspective view of another assembled embodiment of the system according to one or more examples of the present disclosure.

In certain embodiments, this construction allows a plurality of frameworks 102 to be connected, such that the end of the framework 102 with the end cap 104 (e.g., the end of the framework 102 defined by the end 109-1*a* of the panel) connects to an elongate member 107 that is disposed within the band 105 of an end of another framework 102 (e.g., an end of a framework defined by the second end 109-2*b* of the panel 109). As such, from at least one side, as shown in FIG. 11, the panel 109 seems to be of one, unitary construction. The panel 109 may be substantially continuous.

FIG. 4 shows another embodiment of the framework 102. Here, the retaining end pieces 103 include receiving receptacles 124 that are fixedly connected to the saddles 106. In some embodiments, the saddles 106 are curved portions connected to the pieces 103 and configured to guide the elongate member 107 into the receiving receptacles 124.

The saddles 106 may be configured to ease the assembly of the system 100. For instance, the saddles 106 may act as supports and guides for the elongate members 107 as they are inserted into the receptacle of the retaining end pieces 103. The saddle 106 guides the elongate member 107 into the receptacle of the retaining end piece 103. As shown in FIG. 4, in some embodiments, the saddles 106 are curved. In some embodiments, the saddles 106 are shaped similarly to the shape of the elongate members 107 they are receiving. For example, the saddles are curved to receive cylindrically shaped elongate members 107.

FIGS. 5-8 show another embodiment of the framework 102. Here, the framework 102 is made of a monolithic construction. In some embodiments, the framework 102 is manufactured through molding, plastic injection, or 3D printing. The monolithic construction of the framework 102 alleviates the need for a back panel 109.

Instead, the framework 102 comprises a plurality of flanges 108. In one embodiment, each of the number of pieces 103 is coupled to a flange 108 that extends outward from the piece 103 in the first direction d1. In one embodiment, a first flange 108 is connected to a second flange 108 extending outward from an adjacent piece of the number of pieces 103.

In one embodiment, the flanges 108 connect the end cap 104, the plurality of retaining end pieces 103, and the band 105. In one embodiment, the flanges 108 are disposed at the top of the retaining end pieces 103 and extend vertically downward and terminate at the bottom of the saddles 106. The flanges 108 have, in an example shown in FIGS. 6-8, an overlapping tab configuration such that multiple frameworks 102 can mate together to form an enclosed wall. The tab portions 126, in one embodiment, are disposed on the ends of the framework extending from the end cap 104 and the band 105. The tab portions 126 may extend horizontally away from the flange 108 of the retaining end piece 103 towards the end cap 104 and band 105 such that there is a lip formed to secure the flanges 108 extending from the end cap 104 and the band 105. The tabs 126 and the flanges 108 of the framework, in one embodiment, form an offset construction such that the flanges 108 of the side of the framework 102 with the band 105 contact the tab 126 of the side of the framework with the end cap 104 and the flanges 108 of the side of the framework with the end cap 104 contact the tab of the side of the framework 102 with the band 105. This offset construction may help to secure the two sides together with the tabs 126 and flanges 108 coupled with the elongate member 107. Other appropriate sleeve components may alternatively be used in conjunction with, or as an alternative to, the band 105, cap 104, flange 108, and/or end piece 103 components.

Figure 10:
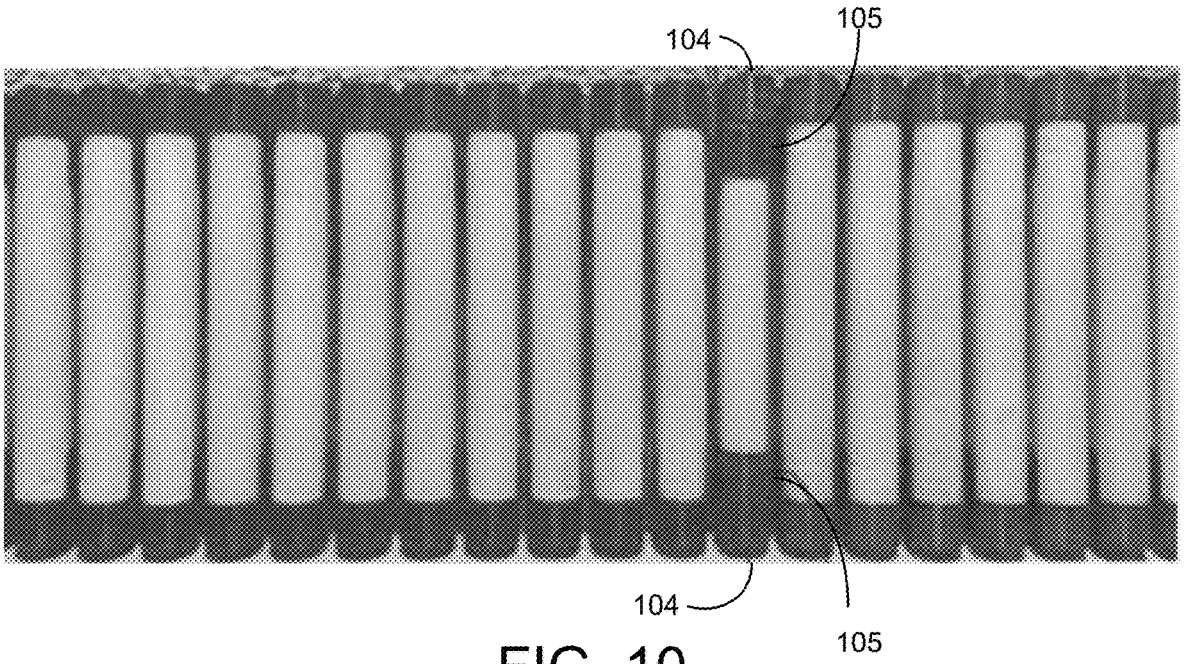
FIG. 10 illustrates a perspective view of an assembled embodiment of the system according to one or more examples of the present disclosure.

Referring to FIGS. 9-11, an embodiment of the system 100 is shown. This embodiment depicts an example of how multiple frameworks 102 can be connected to form a modular retaining wall system 101. In this embodiment, the frameworks 102 are removably connected.

Figure 13:
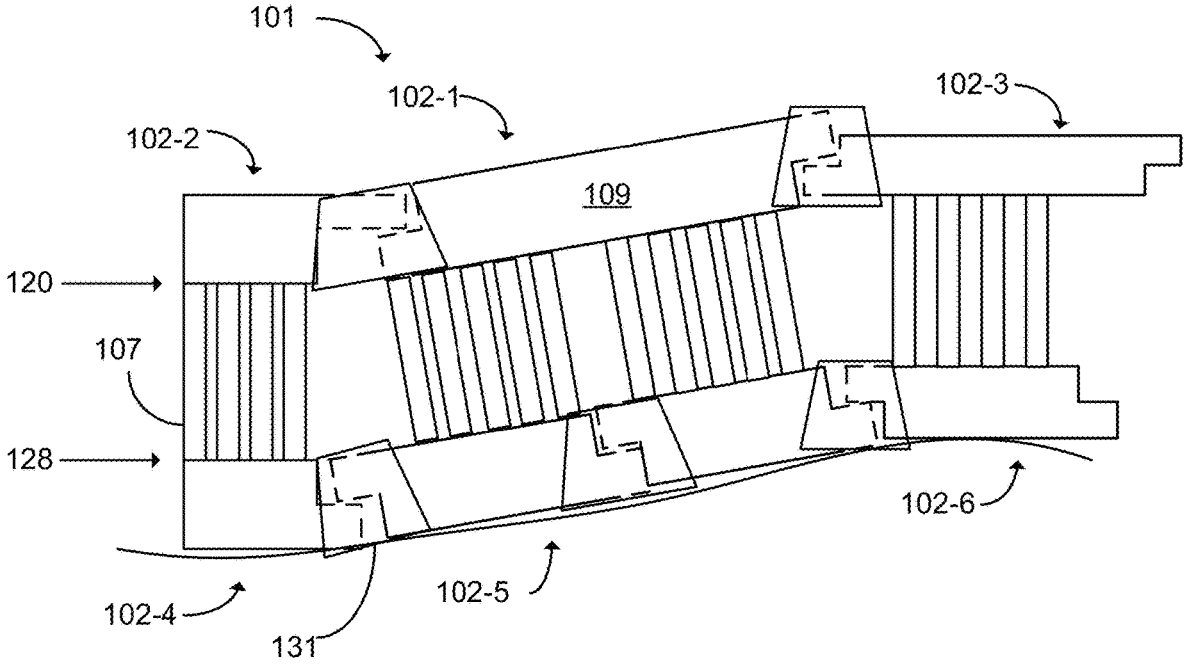
FIG. 13 illustrates a landscape view of another embodiment of the system according to one or more examples of the present disclosure.

As shown in FIG. 13, for example, system 101 includes a first plurality 102-1, 102-2, 102-3 of frameworks 102. The first plurality of frameworks 102-1, 102-2, 102-3 includes a first framework 102-1. The first framework 102-1 includes a first panel 109. The first plurality of frameworks includes a second framework 102-2 adjacent to the first framework 102-1. Although not shown in FIG. 13, the second framework 102-2 includes a band 105 configured to receive an elongate member 107 received by an end cap 104 of the first framework 102-1. The system 101 includes a third framework 102-3 adjacent to the first framework 102-1. The third framework 102-3 includes an end cap 104-3 configured to cover a first end of a second elongate member 107 received by a collar 105-1 of the first framework 102-1.

The system 101 includes a plurality of frameworks (e.g., 102-4, . . . , 102-6) positioned below the top plurality of frameworks (e.g., 102-1, . . . , 102-3). Each framework 102-4, . . . , 102-6 includes a panel 102-4, . . . , 102-6 and a second number of receiving pieces 103. Each piece 103 is coupled to the panel 109 and configured to receive a second end (e.g., end 128 in FIG. 13) of an elongate member 107. The second end 128 is opposite the first end 120.

Although not shown in FIG. 13, each of the top plurality of frameworks 102-1, . . . , 102-3 are connected, and each of the bottom plurality of frameworks 102-4, . . . , 102-6 are connected to form an enclosure 114, as shown in FIG. 1A. As shown in FIG. 13, in some embodiments, a distance between each of the top frameworks 102-1, . . . , 102-3 and the bottom frameworks 102-4, . . . , 102-6 is substantially uniform throughout the enclosure.

Although FIG. 13 illustrates the first plurality of frameworks 102-1, . . . , 102-3 and the second plurality of frameworks 102-4, . . . ,102-6 resting on uneven ground 112 and therefore being connected through pivot members 131, embodiments of the present disclosure are not so limited. For example, the first plurality of frameworks 102-1, . . . , 102-3 are connected in any of manners described and/or illustrated herein. The second plurality of frameworks 102-4, . . . , 102-6, in one embodiment, are connected in any suitable manner. Additionally, in some embodiments, each of the first plurality of frameworks 102-1, . . . , 102-3 and the second plurality of frameworks 102-4, . . . , 102-6 include more than three frameworks each.

The frameworks 102 are connected by inserting an elongate member 107 through the saddles 106 (through end rings 105 (there is no saddle 106 where 2 frameworks 102 join together) of the two framework systems. Referring to FIG. 10, the elongate member 107 is inserted into the receptacles of the end caps 104.

Referring to FIG. 11, a back view is shown. Here, the tabs and the flanges of the end caps 104 and band 105 nest together. This nesting joins the two modular style systems (e.g., two wall modules) into one cohesive, connected system. As shown in FIG. 11, in some embodiments, the frameworks 102 are configured such that the panels 109 of each framework of a top plurality of frameworks 102-1, . . . , 102-3 contact the other panels 109 of the first plurality of frameworks 102-1, . . . , 102-3, to form a substantially continuous surface. For example, there are little to no gaps or overlapping in the panels 109.

Figure 12:
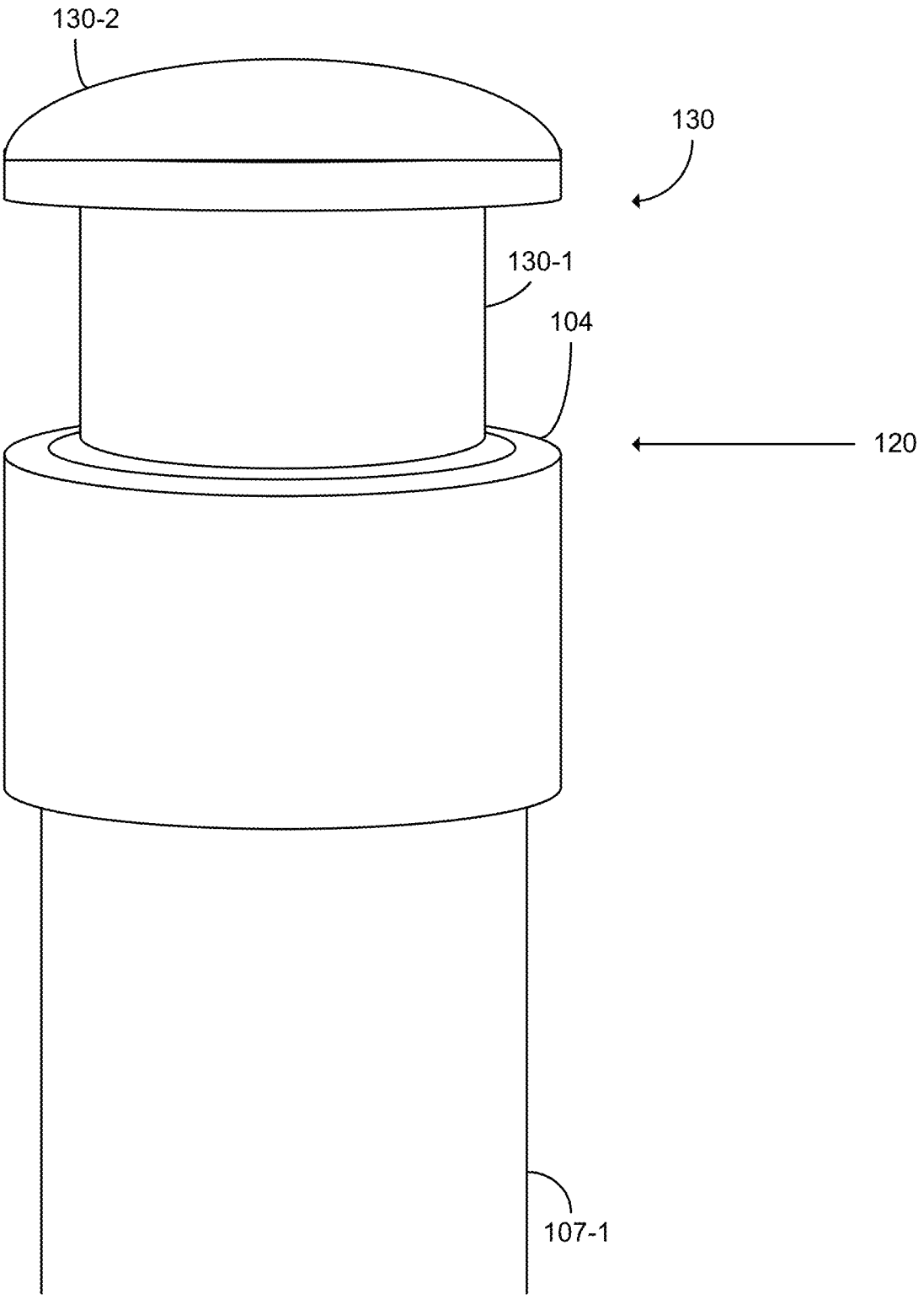
FIG. 12 illustrates an embodiment of a component of the system according to one or more examples of the present disclosure.

Referring to FIG. 12, an alternate embodiment of the end cap 104 is shown. In one embodiment, the end cap 104 is comprised of a telescoping top 130. The telescoping top 130, in some embodiments, is a separate insertable cap. In one embodiment, the telescoping top 130 is configured to extend outward from the end cap 104 when connecting frameworks 102. In one embodiment, the telescoping top 130 extends outward such that for easier insertion of the elongate member 107 into the end cap 104. In one embodiment, the telescoping top 130 encompasses the elongate member 107 and has clearance to extend into and out of the end cap 104. In one embodiment, the elongate member 107 is removably coupled to the telescoping top 130 by a friction fit, which may alleviate the need for fasteners or glues. In one embodiment, the telescoping top 130 is alternatively fixed via twist locks, tabs, notches, friction guides, screws, pin(s), adhesive, snaps, eyelets, grommets, hook and eyes, loop fasteners, magnets, press studs, toggles, hook and loop fabric, zipper, or any appropriate means to removably fix the telescoping top 130.

In one embodiment, the telescoping top 130 includes a first portion 130-1 configured to fit within the elongate member 107 at the first end 120 of the elongate member 107-1. In one embodiment, the telescoping top 130 includes a second portion 130-2 coupled to the first portion 130-1 that is wider than the end cap 104.

Although not illustrated herein, in some embodiments, the retaining pieces 103 include caps that are removable. For example, the caps may be removable as the telescopic top 130 of the end cap 104 shown in FIG. 12 is removable. The caps of the retaining pieces 103 are configured to cover the ends of the elongate members 107.

Referring to FIG. 13, an alternative system 101 for building a wall is shown. The system is comprised of a number of frameworks 102, elongate members 107, and pivot pieces 131. In this embodiment the system 101 is building a wall on hilly terrain. The pivot pieces 131 allow for the frameworks to rotationally pivot according to the contours of the terrain. This allows for the system 101 to conform to uneven terrains as well as substantially level terrains not pictured in FIG. 13.

The pivot pieces 131 connect a first framework 102-1 to a second framework 102-2. The pivot pieces 131 pivot so that the distance between the top frameworks 102 and the bottom frameworks 102 stays the same. Moreover, this allows for the elongate members 107 to remain uniform. Pivot pieces 131 may also be hinged or offset-hinged along the perpendicular axis, or 360° axes via any hinged or spheroid joint or appropriate pivoting mechanism to provide additional degrees of directional capacity and utility if needed.

Referring to FIG. 11, a view of system 101 is shown. In this view the system 101 is bent, or forced to bend, to conform to a circular shape, e.g., when used as a retaining wall for an in-ground trampoline. As shown in FIG. 11, the spacing between the elongate members 107 increases as a result of the bend. As such, when the excavation to insert the system 101 into the ground is backfilled, there is room for the backfill to filter through the spaces between the elongate members 107.

Referring to FIG. 1C, in some embodiments of system 101, there may be a guard-shield style barrier 118 disposed on at least one side of the frameworks 102 to prevent unwanted backfill from filtering through though the system. In one embodiment, the barrier 118 includes a material not permeable to materials of the ground 112. For example, canvas or another appropriate material may be provided, which prevents the backfill from filtering through the spaces that is included. In one embodiment, the canvas (or other appropriate guard) prevents the backfill from filtering through the spaces of the elongate members 107. The canvas (or other appropriate guard), in one embodiment, is attached to the system 101 via a plurality of heavy-duty zip ties, or removably fixed to the framework 102 with any appropriate fastening means. In some embodiments, the guard is a backfill guard configured to extend a length of the elongate members and couple to the corners of the wall.

In some embodiments, the zip ties are dispersed about the system 101 in an even manner, such that there is no slack in the canvas and such that it remains tightly pressed against the system 101. The guard may also come pre-assembled or pre-attached to the framework 102.

In some embodiments, a method for making a retaining wall includes excavating a location for placing a framework 102 for a wall. In some embodiments, a method includes installing a plurality of frameworks 102 downward in the location. In some embodiments, a method includes inserting a plurality of elongate members 107 into the plurality of retaining end pieces 103, end caps 104, and bands 105. In some embodiments, a method includes placing a plurality of frameworks 102 over the plurality of elongate members 107. This is done, in one embodiment, by inserting the elongate members into the retaining end pieces 103, end caps 104, and bands 105.

In some embodiments, a method includes adjusting the placement of the system 101 to conform to a selected shape. In some embodiments, a method includes attaching a canvas to the system 101 between the system 101 and the side that is to be backfilled. A method of attachment may include heavy duty zip ties dispersed evenly around the system, at the top and bottom frameworks 102. In some embodiments, a method includes backfilling the excavation on the outside of the system 101. In some embodiments, a method includes inserting a trampoline and/or other in-ground play unit into the enclosure (or the open area) within the system 101. In some embodiments, a method includes attaching the trampoline to the system 101. The trampoline may be attached by zip ties, fasteners, rope, string, bungees, or any another means.

Figure 14:
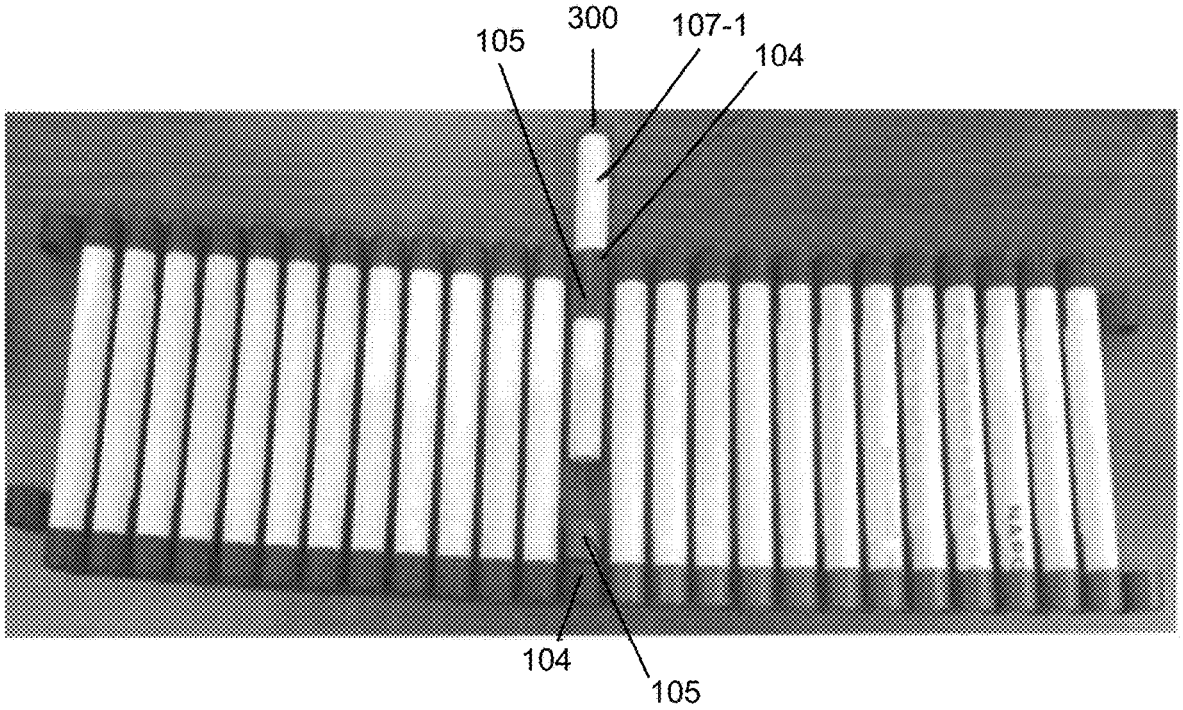
FIG. 14 illustrates a perspective view of an embodiment of assembling of the system according to one or more examples of the present disclosure.
Figure 15:
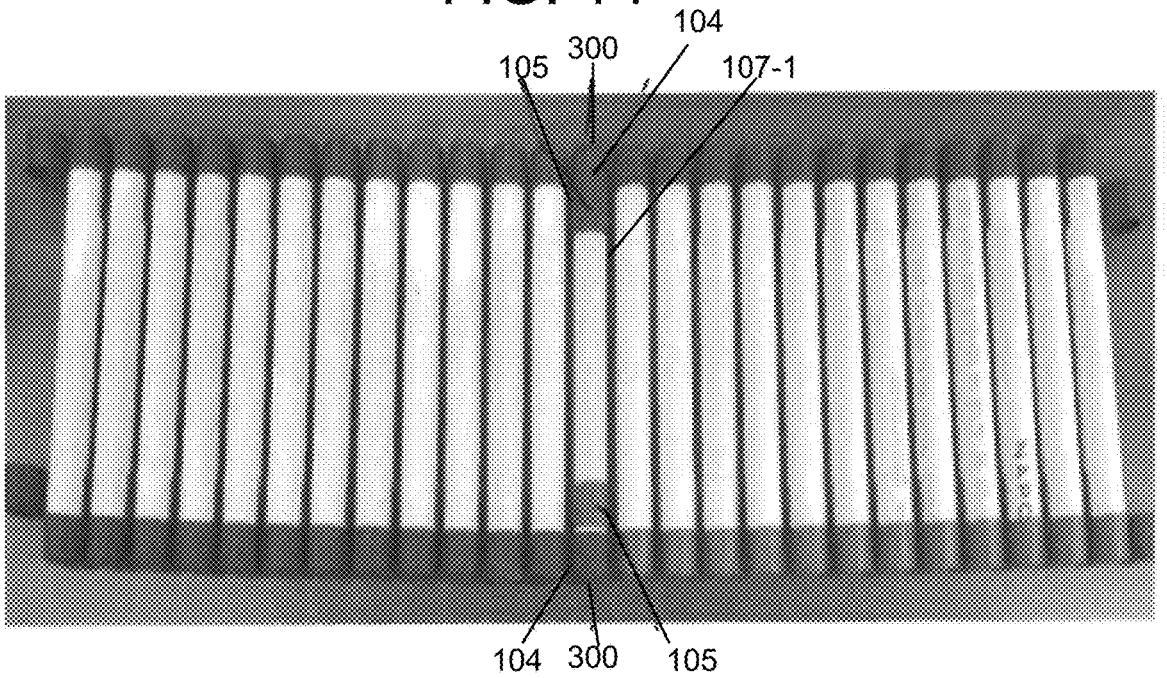
FIG. 15 illustrates a perspective view of an assembled embodiment of the system according to one or more examples of the present disclosure.
Figure 16A:
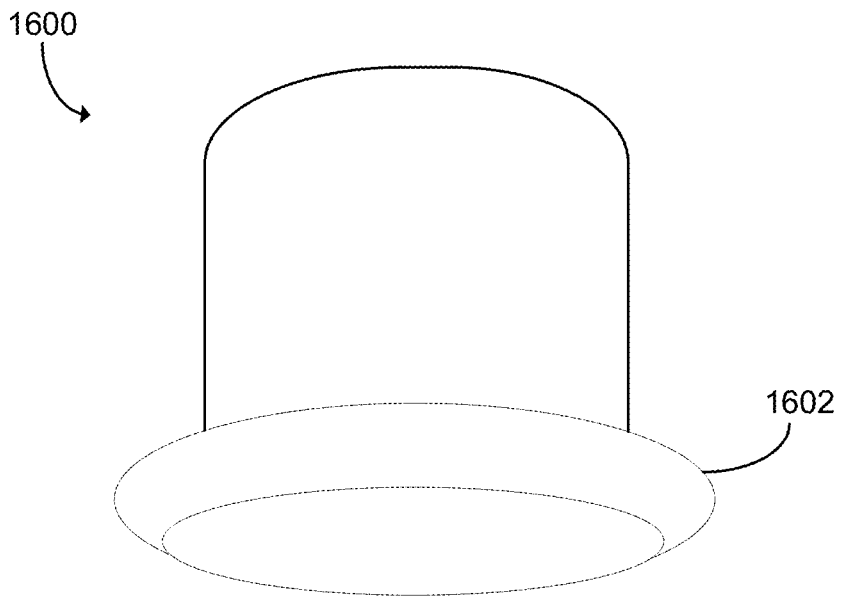
FIG. 16A illustrates one embodiment of a component of the system, according to one or more examples of the present disclosure.
Figure 16B:
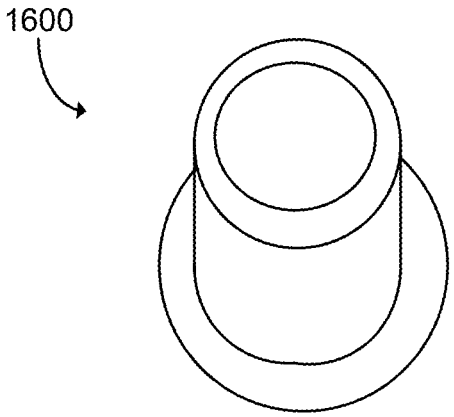
FIG. 16B illustrates one embodiment of a component of the system, according to one or more examples of the present disclosure.
Figure 16C:
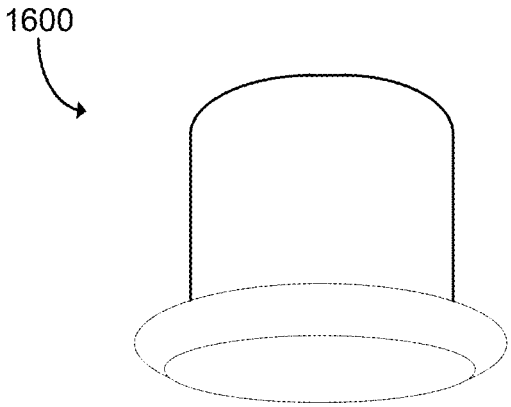
FIG. 16C illustrates one embodiment of a component of the system, according to one or more examples of the present disclosure.

Referring to FIGS. 14-16, an alternative embodiment is shown. In this embodiment, the end cap 104 is configured similar to the band 105, such that the end cap 104 is a through channel for the elongate member 107 to pass through. This alternative embodiment may include a cap 1600 for the end cap 104, shown in FIGS. 16A-16C. The cap 1600 may be configured to act as a plug. The cap 1600, in one embodiment, inserts into the elongate member 107 such that the head 1602 portion of the cap prevents the cap from passing through the end cap 104. The head portion 1602 of the cap 1600 may be configured to be wider than the inside diameter of the end cap 104 to prevent the elongate member 107 to pass through the end cap 104.

Figure 17:
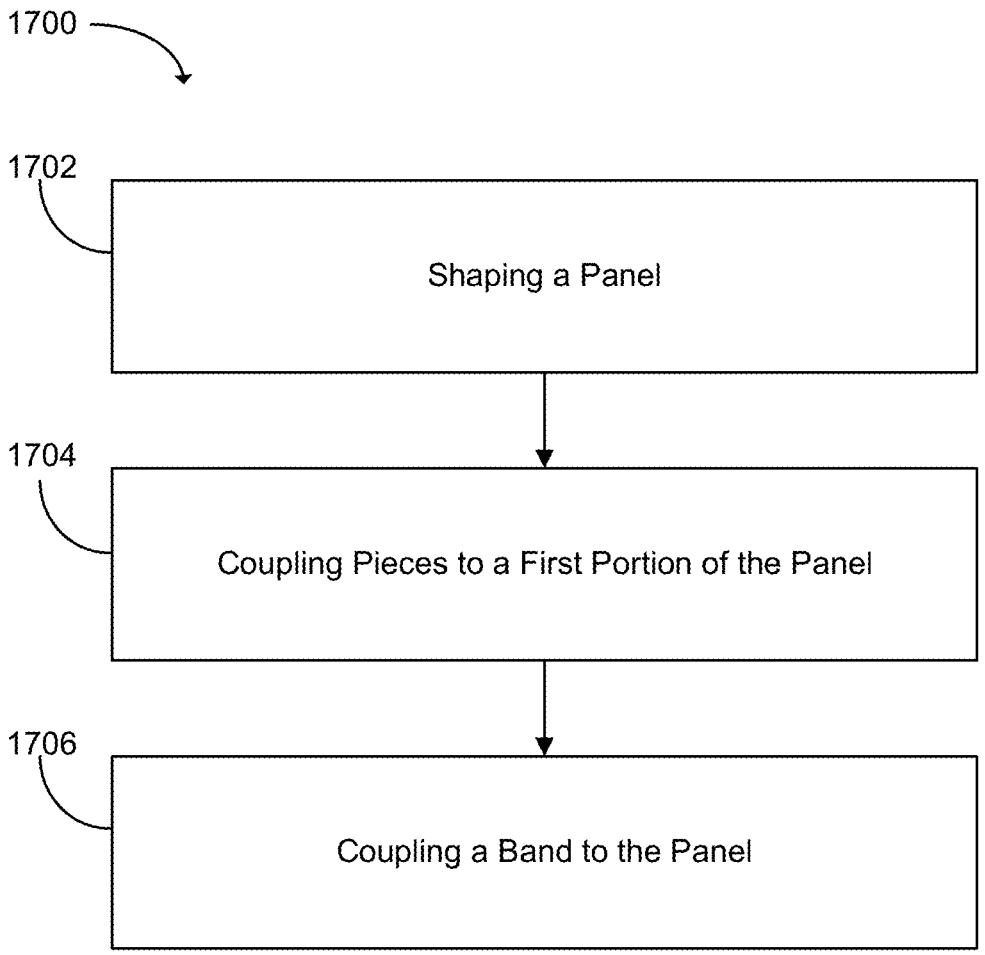
FIG. 17 illustrates a schematic flow chart diagram of one embodiment of a method for assembling the system according to one or more examples of the present disclosure.

FIG. 17 illustrates a method 1700 for assembling an embodiment of a wall illustrated in FIGS. 14 and 15. The method 1700 begins and shapes 1702 a panel 109 such that the panel 109 includes a first portion having an end and a second portion having a first end offset laterally from the end of the first portion in a first direction along a virtual plane. The method 1700, in one embodiment, couples 1704 a plurality of pieces 103 to the first portion of the panel 109, each piece 103 of the plurality of pieces 103 is configured to receive an end of an elongate member 107 of a plurality of elongate members 107. The plurality of pieces 103 may include a first piece proximate to the end of the first portion of the panel 109 and configured to receive an end of a first elongate member 107 of the plurality of elongate members 107. The method 1700, in one embodiment, couples 1706 a band 105 to the first panel in a position proximate to a second end of the second portion opposite to the first end of the second portion. The band 105 may be configured to receive a second elongate member of the plurality of elongate members. The band 105 may be offset from the first piece in the second direction. At least one of the plurality of elongate members 107 extends in a second direction substantially perpendicular to the first direction.

In some embodiments, the method 1700 also includes acquiring a top portion for the wall and a bottom portion of the wall, acquiring a plurality of elongate members 107, and inserting the elongate members into the plurality of the retaining end pieces 103. The method 1700 includes connecting the plurality of frameworks 102 together. In some embodiments, this is done by inserting a cap into the end cap 104 of the bottom portion of the wall and then by inserting an elongate member 107 into the end cap 104 of the top portion and bottom portion of the wall. The cap is inserted into the elongate member 107 as the elongate member 107 is inserted into the end cap 104 of the bottom portion of the wall. The connection is completed by inserting a cap into the end cap 104 of the top portion of the wall.

In some embodiments, the method 1700 also includes forming, fittings, aperture(s), hinges, latches, assemblies, doors, gates, guards, screens, jambs, or any combination thereof for one or more optional entry/exit points.

According to embodiments of the present disclosure, the band 105, end cap 104, receiving pieces 103, and/or panel are made of at least one of the following: polyethylene, plastic, wood, metal, polyvinyl chloride, or any combination thereof.

According to embodiments of the present disclosure, the elongated members 107 can be made of plastic, PVC, metal, wood, or any combination thereof. However, embodiments of the present disclosure are not so limited. The elongate members 107 may be any length and shape. For example, the elongate members 107 may be substantially round, rectangular, square, triangular, hexagonal, or any combination thereof.

In the above description, certain terms may be used such as "up," "down," "upper," "lower," "horizontal," "vertical," "left," "right," "over," "under" and the like. These terms are used, where applicable, to provide some clarity of description when dealing with relative relationships. But these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two." Moreover, unless otherwise noted, as defined herein a plurality of particular features does not necessarily mean every particular feature of an entire set or class of the particular features.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

The schematic flow chart diagrams included herein are generally set forth as logical flow chart diagrams. As such, the depicted order and labeled steps are indicative of one example of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

The present subject matter may be embodied in other specific forms without departing from its spirit or essential characteristics. The described examples are to be considered in all respects only as illustrative and not restrictive. All changes which come within the meaning and range of equivalency of the claims are to be embraced within their scope.

What is claimed is:

1. A wall module, comprising:

a panel, comprising a first portion having an end and a second portion having a first end offset laterally from the end of the first portion in a first direction along a virtual plane;

a plurality of pieces coupled to the first portion of the panel, each piece of the plurality of pieces configured to receive an end of an elongate member of a plurality of elongate members, the plurality of pieces comprising a first piece proximate to the end of the first portion of the panel and configured to receive an end of a first elongate member of the plurality of elongate members; and a band coupled to the second portion in a position proximate to a second end of the second portion opposite to the first end of the second portion, the band configured to receive a second elongate member of the plurality of elongate members, wherein at least one of the plurality of elongate members extends in a second direction substantially perpendicular to the first direction and the band is offset from the first piece in the second direction.

2. The wall module of claim 1, wherein:

each of the plurality of pieces further comprises a receiving receptacle; and the wall module further comprises a curved portion connected to at least one piece of the plurality of pieces, the curved portion being configured to guide the end of the elongate member into the receiving receptacle.

3. The wall module of claim 1, wherein each of the plurality of elongate members are substantially cylindrical in shape.

4. The wall module of claim 1, wherein each of the plurality elongate members extends a length at least equal to the depth of a hole in the ground.

5. The wall module of claim 1, wherein the panel is made of a flexible material.

6. The wall module of claim 1, wherein the plurality of pieces further comprises pieces disposed between the first piece and the band in the first direction.

7. The wall module of claim 1, wherein the panel comprises a plurality of flanges.

8. The wall module of claim 7, wherein each of the number of pieces is coupled to a first flange of the number of flanges extending outward from the piece in a first direction, wherein the first flange is connected to a second flange of the number of flanges extending outward from an adjacent piece of the number of pieces.

9. The wall module of claim 1, at least one of the plurality of pieces comprising a removable cap configured to cover the end of the elongate member.

10. The wall module of claim 8, wherein the removable cap further comprises a telescoping top.

11. The wall module of claim 1, further comprising a cap, the cap comprising:

a first portion configured to fit within the first elongate member at the first end of the first elongate member; and a second portion coupled to the first portion and having a width greater than a width of the first piece.

12. A modular retaining wall system, comprising:

a first plurality of wall modules, each wall module of the plurality of wall modules comprising:

a first wall module, comprising:

a first panel, comprising a first portion having an end and a second portion having a first end offset laterally from the end of the first portion in a first direction along a virtual plane;

a plurality of pieces coupled to the first portion of the first panel, each piece of the plurality of pieces configured to receive an end of an elongate member of a plurality of elongate members, the plurality of pieces comprising:

at least one piece extending in a second direction substantially perpendicular to the first direction; and a first piece proximate to the end of the first portion of the panel and configured to receive an end of a first elongate member of the plurality of elongate members; and a band coupled to the second portion, positioned proximate to a second end of the second portion opposite to the first end of the second portion, and configured to receive a second elongate member of the plurality of elongate members;

a second wall module adjacent to the first wall module, the second wall module comprising a band configured to receive the first elongate member; and a third wall module adjacent to the first wall module, the third wall module comprising a piece configured to receive and cover a first end of the second additional elongate member; and a second plurality of wall modules, each wall module of the second plurality of wall modules comprising:

a panel; and a second number of pieces, each piece of the second number of pieces coupled to the panel and configured to receive a second end of an elongate member of the number of elongate members, wherein the second end comprises an end opposite to the first end.

13. The system of claim 12, wherein each of the first plurality of wall modules and the second plurality of wall modules are configured to be connected through the number of elongate members to form an enclosure.

14. The system of claim 13, wherein the enclosure is substantially circular in shape.

15. The system of claim 12, wherein at least one of the wall modules of the first plurality of wall modules and/or the second plurality of wall modules is configured to be connected to at least one of an in-ground pool or a frame of an in-ground trampoline.

16. The system of claim 12, further comprising a material not permeable to earth disposed on at least one side of the first plurality of wall modules.

17. The system of claim 13, wherein a distance between each of the first plurality of wall modules and the second plurality of wall modules is substantially uniform throughout the enclosure.

18. The system of claim 12, further comprising a number of pivot members, each pivot member of the number of pivot member being rotatable about an axis substantially perpendicular to the first direction and to the second direction and connecting at least one of (i) a first wall module of the first plurality of wall modules to a second wall module of the first plurality of wall modules and (ii) a first wall module of the second plurality of wall modules to a second wall module of the second plurality of wall modules.

19. The system of claim 12, wherein the first plurality of wall modules are configured such that the panel of each wall module contacts a panel of the first adjacent wall module and the second adjacent wall module such that each panel of the first plurality of wall modules forms a substantially continuous surface.

20. A method of building a retention wall, comprising:

shaping a panel such that the panel comprises a first portion having an end and a second portion having a first end offset laterally from the end of the first portion in a first direction along a virtual plane;

coupling a plurality of pieces to the first portion of the panel, each piece of the plurality of pieces configured to receive an end of an elongate member of a plurality of elongate members, the plurality of pieces comprising a first piece proximate to the end of the first portion of the panel and configured to receive an end of a first elongate member of the plurality of elongate members; and coupling a band to the panel in a position proximate to a second end of the second portion opposite to the first end of the second portion, wherein the band is:

configured to receive a second elongate member of the plurality of elongate members; and offset from the first piece in the second direction, wherein at least one of the plurality of elongate members extends in a second direction substantially perpendicular to the first direction.

* * * * *